US006626489B2

(12) United States Patent
Geis et al.

(10) Patent No.: US 6,626,489 B2
(45) Date of Patent: Sep. 30, 2003

(54) INFANT SEAT PROVIDING A CUSHIONED CARRY

(75) Inventors: Mark W. Geis, Tipp City, OH (US); Paul F. Fair, Denver, CO (US)

(73) Assignee: Evenflo Company, Inc., Vandalia, OH (US)

( * ) Notice: Subject to any disclaimer, the term of this patent is extended or adjusted under 35 U.S.C. 154(b) by 59 days.

(21) Appl. No.: 09/908,069

(22) Filed: Jul. 18, 2001

(65) Prior Publication Data

US 2003/0015896 A1 Jan. 23, 2003

(51) Int. Cl.[7] ..... A47C 7/62

(52) U.S. Cl. ..... 297/183.1; 297/183.2; 297/183.3; 297/183.4; 224/160

(58) Field of Search ..... 297/183.1, 183.2, 297/183.3, 183.4; 224/160

(56) References Cited

U.S. PATENT DOCUMENTS

| | | | | | |
|---|---|---|---|---|---|
| 3,481,517 | A | * | 12/1969 | Aukerman | 224/160 |
| 4,681,368 | A | | 7/1987 | Heath et al. | |
| 4,997,231 | A | * | 3/1991 | Smith | 297/184.13 |
| 5,178,309 | A | * | 1/1993 | Bicheler et al. | 224/153 |
| 5,267,680 | A | * | 12/1993 | Torok | 224/158 |
| 5,322,343 | A | * | 6/1994 | Parker et al. | 297/183 |
| 5,330,250 | A | | 7/1994 | Reyes | |
| 5,385,387 | A | | 1/1995 | Kain | |
| 5,395,154 | A | | 3/1995 | Wang | |
| 5,468,047 | A | * | 11/1995 | Goor et al. | 297/250.1 |
| 5,540,365 | A | | 7/1996 | LaMair | |
| 5,658,044 | A | * | 8/1997 | Krevh | 297/183.6 |
| 5,676,386 | A | | 10/1997 | Huang | |
| 5,692,655 | A | * | 12/1997 | Fair et al. | 224/160 |
| 5,730,490 | A | * | 3/1998 | Mortenson | 297/184.13 |
| 5,775,770 | A | | 7/1998 | Tunney | |
| 5,820,215 | A | | 10/1998 | Dreisbach | |
| 5,961,180 | A | * | 10/1999 | Greger et al. | 297/183.4 |
| 6,354,475 | B1 | * | 3/2002 | Grace et al. | 224/158 |
| 6,386,632 | B1 | * | 5/2002 | Goor et al. | 297/216.11 |

* cited by examiner

*Primary Examiner*—Peter M. Cuomo
*Assistant Examiner*—Joseph Edell
(74) *Attorney, Agent, or Firm*—Taft, Stettinius & Hollister LLP

(57) ABSTRACT

An infant seat (which is also known as an infant carrier) includes a shell having sidewalls and a handle having arms attached to the sidewalls. A cushion pad may be attached to an arm and partially defines an inwardly-facing surface of the arm. Preferably this cushion pad contacts the crook of an elbow of a user who is carrying the infant seat by wrapping the crook of the elbow around the first arm of the handle. Another cushion pad may be attached to either the outwardly-facing surface of the shell or the similarly-facing surface portion of the arm. Preferably, this cushion pad contacts the hip of the user.

5 Claims, 6 Drawing Sheets

INFANT SEAT PROVIDING A CUSHIONED CARRY

BACKGROUND OF THE INVENTION

The present invention relates generally to infant seats (which are also called infant carriers), and more particularly to an infant seat which provides a cushioned carry for the user.

Conventional infant seats include an infant seat having a rigid shell and a rigid handle having two arms attached to the sides of the shell. The shell defines a cavity for receiving an infant. It is known to carry an infant in the infant seat by placing the crook (i.e., the inside bend) of the elbow of the user around the closest arm of the handle to carry the infant seat along the side of the body.

In one known infant seat, a single-arm handle has a cuff, and the tray (i.e., the shell) has a hand grip which is a contoured opening in the side of the shell. The user carrying the infant in the infant seat places his or her forearm through the cuff and then grabs the hand grip to carry the infant seat on the side of the hip. An integral, contoured hip pad is provided on each sidewall of the carrier for an additional weight bearing surface to reduce the stress of the weight of the shell to the arm of the user.

In another known infant seat having a shell and a rigid handle having arms attached to the sides of the shell, a flexible shoulder strap is added having ends attached to the front and back of the shell. A cushioning hip pad is added to the infant seat. The hip pad has openings to receive connecting ends of support straps and is recessed to fit over the socket (i.e., the hub) of the arm of the handle, and the hip pad may have an additional connecting strap to secure the hip pad to the handle. The outer exposed surface of the hip pad is concave to conform to the hip region of the user since the infant seat will ride against the hip when suspended from the shoulder by the shoulder strap.

What is needed is an infant seat providing a more convenient cushioned carry for the user.

SUMMARY OF THE INVENTION

A first expression of a preferred embodiment of the invention is for an infant seat including an infant-seat shell, a handle, and a first cushion pad. The infant-seat shell includes first and second sidewalls. The handle includes a first arm attached to the first sidewall, a second arm attached to the second sidewall, and a hand-grip located between, and attached to, the first and second arms. The first arm has a first inwardly-facing surface, and the second arm has a second inwardly-facing surface. The first cushion pad is attached (and preferably permanently attached) to the first arm and defines a portion of the first inwardly-facing surface. Preferably, the first cushion pad is located to contact a crook of an elbow of a user who is carrying the infant seat by supporting the first arm of the handle in the crook of the elbow. It is also preferred that the infant seat also include a second cushion pad which is attached (and preferably permanently attached) to the second arm and which defines a portion of the second inwardly-facing surface of the second arm.

A second expression of a preferred embodiment of the invention is for an infant seat including an infant-seat shell, a handle, and a third cushion pad. The infant-seat shell includes a first sidewall having a first outwardly-facing surface and includes a second sidewall having a second outwardly-facing surface. The handle includes a first arm attached to the first sidewall, a second arm attached to the second sidewall, and a hand-grip located between, and attached to, the first and second arms. The first arm has a first outwardly-facing surface portion which faces away from the second arm, and the second arm has a second outwardly-facing surface portion which faces away from the first arm. The third cushion pad is attached (and preferably permanently attached) to one of the first sidewall and the first arm and defines a portion of a corresponding one of the first outwardly-facing surface of the first sidewall and the first outwardly-facing surface portion of the first arm. Preferably, the third cushion pad is located to contact a hip of an average-sized adult user who is carrying the infant seat by supporting the first arm of the handle in a crook of an elbow. It is also preferred that the infant seat also include a fourth cushion pad which is attached (and preferably permanently attached) to one of the second sidewall and the second arm and which defines a portion of a corresponding one of the second outwardly-facing surface of the second sidewall and the second outwardly-facing surface portion of the second arm.

A third expression of a preferred embodiment of the invention is for an infant seat. The third expression combines the elements of the previously described first and second expressions.

Several benefits and advantages are derived from the invention. The hand grip of the two-armed handle allows a user to conveniently grasp and carry the infant seat for short distances. For longer distances, the two arms of the handle allow a right or left arm one-hand carry of the cushion seat by having the user place his or her forearm around one of the arms of the handle to primarily support the infant seat from the crook (i.e., the inside bend) of the elbow of the user and to secondarily support the infant seat from and/or against the hip of the user. The first (and second) cushion pad provides comfort for the crook of the elbow of the user, and the third (and fourth) cushion pad provides comfort for the hip of the user.

DETAILED DESCRIPTION

A preferred embodiment of the invention is for an infant seat 10 and is shown in FIGS. 1–4 with optional child padding and optional child harness straps removed for clarity as child padding and child harness straps do not constitute a part of the invention. Infant seats are also known as infant carriers. The terminology "infant seat" includes, without limitation, infant seats, with or without a base (not shown), which are adapted for installation in a vehicle, which are adapted for installation in a stroller, and which are used by themselves to hold an infant while the infant seat is placed on, for example, a table or lawn or is being carried about.

Figure 1:
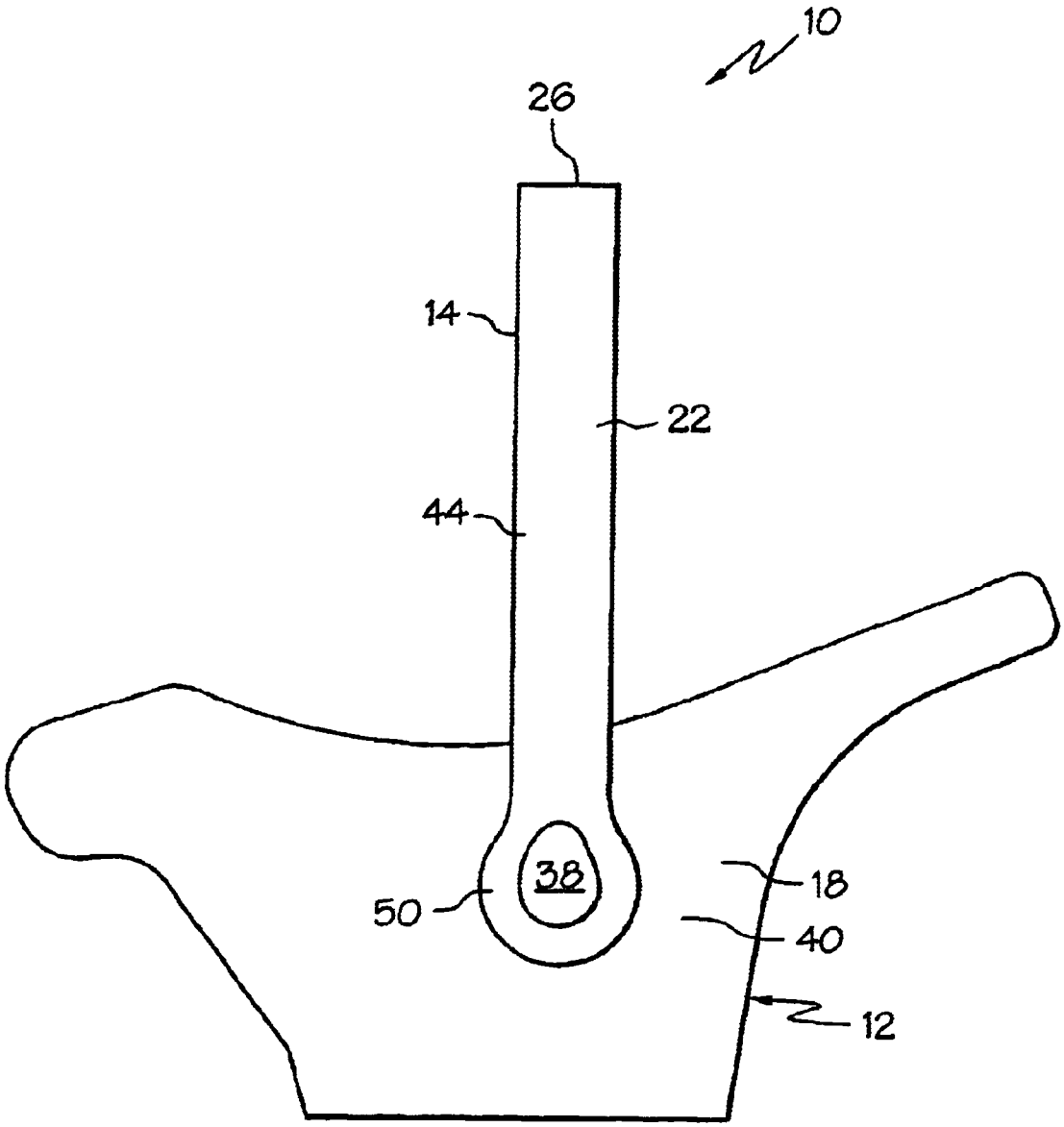
FIG. 1 is a schematic, side elevational view of a preferred embodiment of an infant seat (also known as an infant carrier) of the invention.
Figure 2:
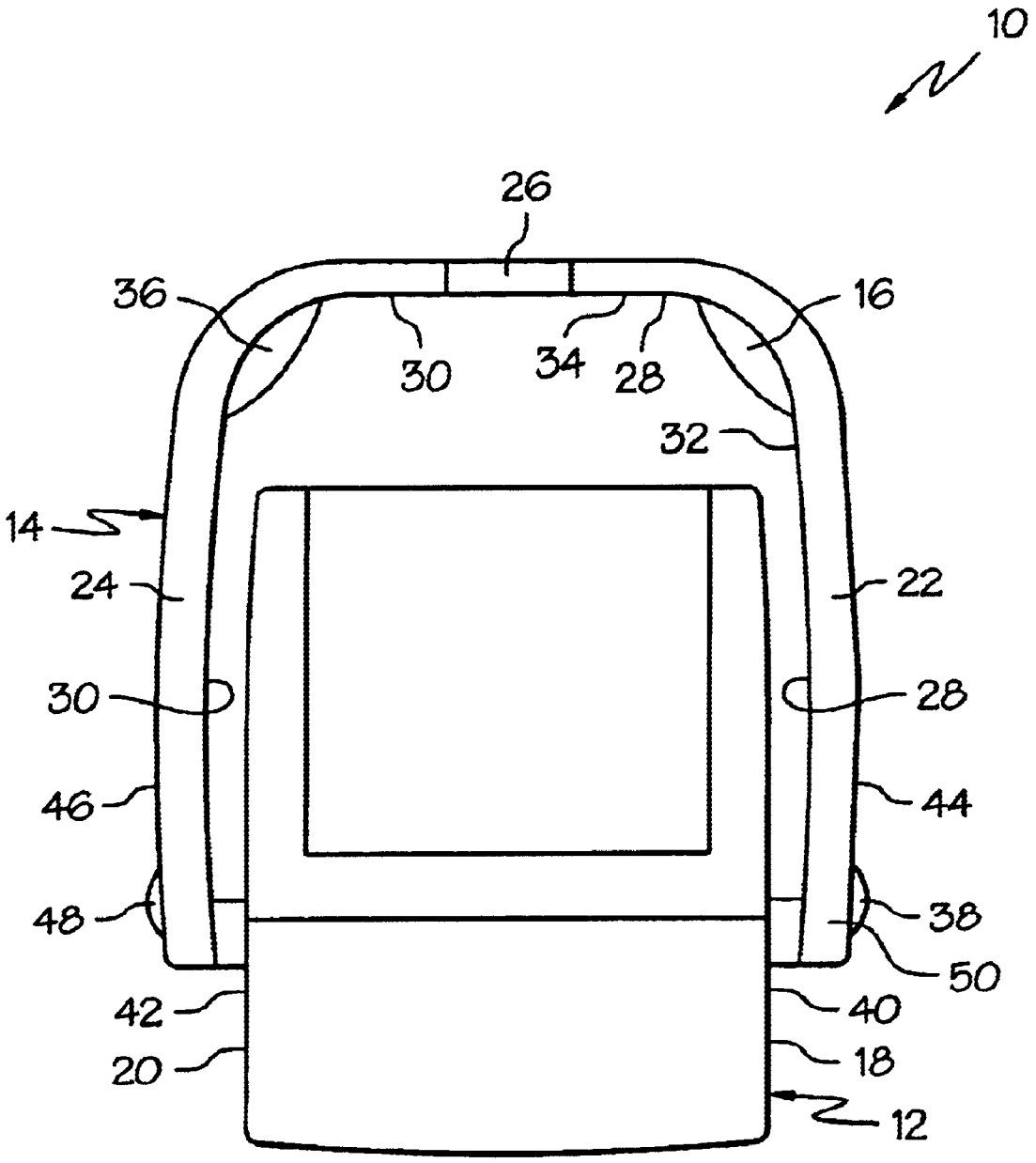
FIG. 2 is a schematic, front elevational view of the infant seat of FIG. 1.
Figure 3:
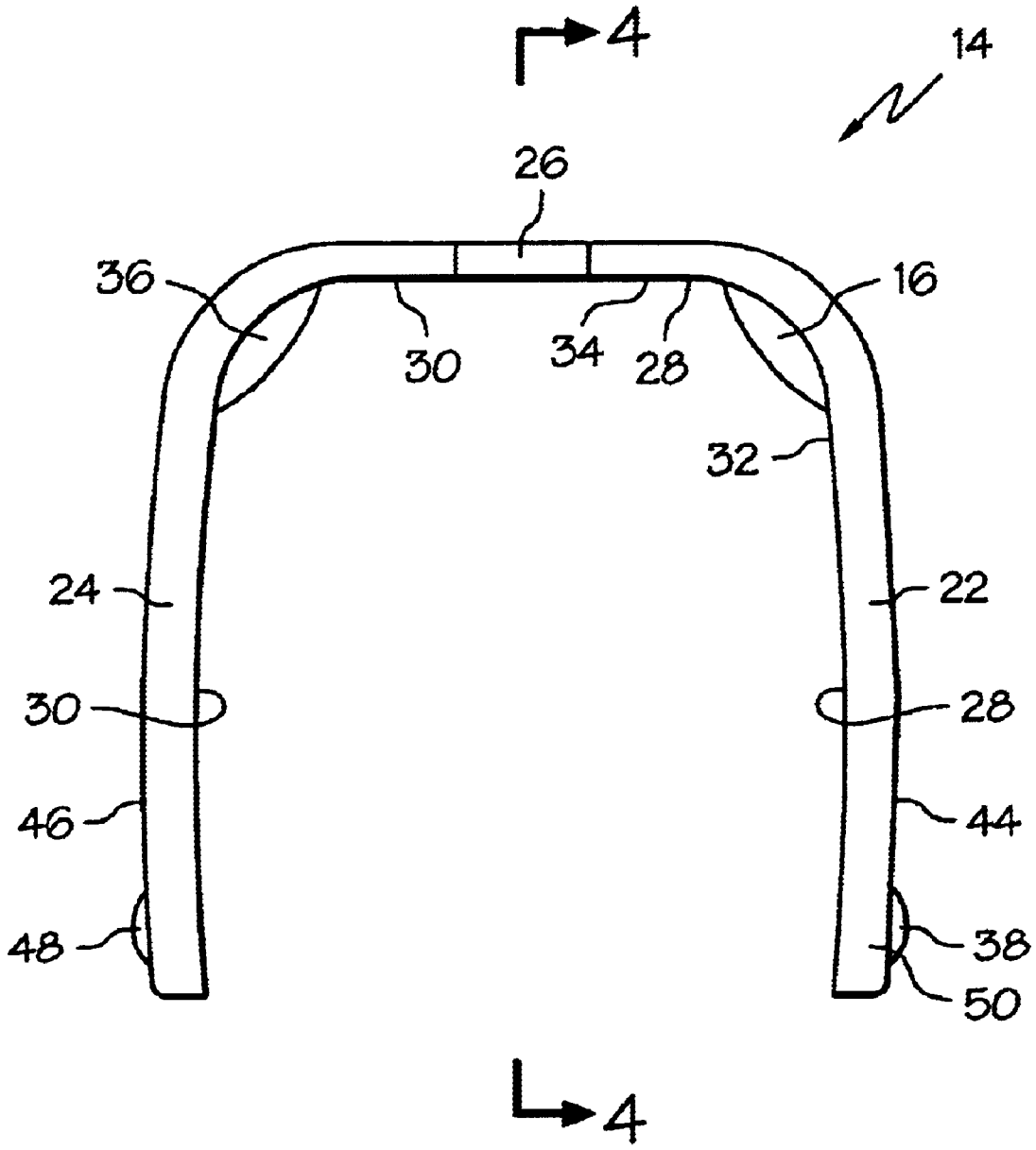
FIG. 3 is a schematic, front elevational view of the handle of the infant seat of FIG. 1.
Figure 4:
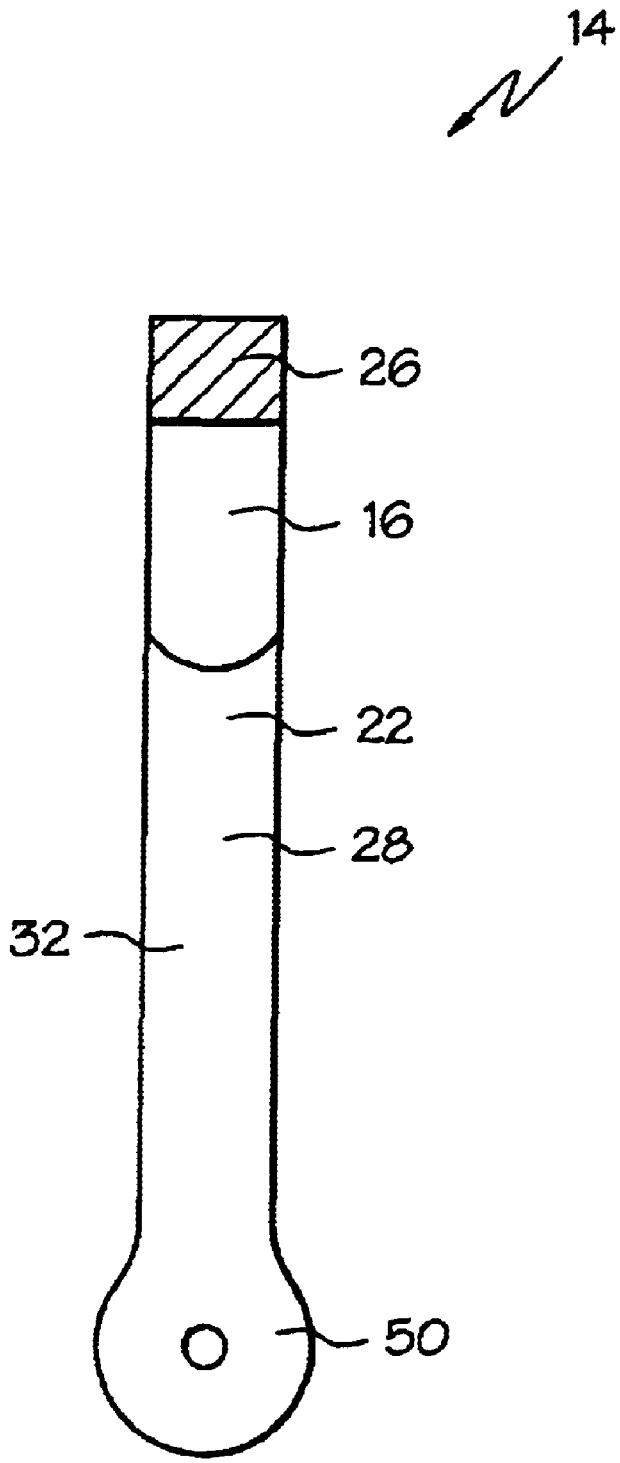
FIG. 4 is a cross-sectional view of the handle of FIG. 3 taken along lines 4—4 of FIG. 3.

In a first expression of the preferred embodiment of the invention shown in FIGS. 1–4, the infant seat 10 includes an infant-seat shell 12, a handle 14, and a first cushion pad 16. The infant-seat shell 12 includes first and second sidewalls 18 and 20. The handle 14 includes a first arm 22 attached to the first sidewall 18, a second arm 24 attached to the second sidewall 20, and a hand-grip 26 disposed between, and attached to, the first and second arms 22 and 24. The hand grip is that portion of the top (as seen in FIG. 2) of the handle which would be grasped by one hand of a user to carry the infant seat (with or without an infant in the infant-seat shell) a short distance. The first arm 22 has a first inwardly-facing surface 28, and the second arm has a second inwardly-facing surface 30. It is noted that the first inwardly-facing surface 28 extends from the hand grip 26 to where the first arm 22 is attached to the first sidewall 18, and that the second inwardly-facing surface 30 extends from the hand grip 26 to where the second arm 24 is attached to the second sidewall 20. The first cushion pad 16 is attached to the first arm 22 and defines a portion of the first inwardly-facing surface 28. It is noted that the first cushion pad 16 defining a portion of the first inwardly-facing surface 28 includes the first cushion pad 16 covering a portion of the first inwardly-facing surface 28 and/or creating a new portion of the first inwardly-facing surface 28. It is further noted that the first cushion pad 16 is softer and more resilient than the adjacent non-cushion-pad portion of the first inwardly-facing surface 28 of the first arm 22 of the handle 14, and preferably the first cushion pad 16 protrudes above the adjacent non-cushioned-pad portion of the first inwardly-facing surface 28.

In one example, the first inwardly-facing surface 28 of the first arm 22 has a first section 32 facing substantially toward the second arm 24, and the first cushion pad 16 defines a portion of the first section 32. In another example, the first inwardly-facing surface 28 of the first arm 22 has a second section 34 facing substantially toward the infant-seat shell 12, and the first cushion pad 16 defines a portion of the second section 34. In a further example, the first cushion pad 16 defines a minority portion of the first inwardly-facing surface 28 of the first arm 22. Preferably, the first cushion pad 16 is permanently attached to the first arm 22. By "permanently attached" is meant that the first cushion pad 16 is not designed to be removed by the user of the infant seat 10 and preferably also is meant that the first cushion pad 16 cannot be removed without damage to the first cushion pad 16, or the first arm 22, or both. In an additional example, the first cushion pad 16 is disposed to contact a crook (i.e., the inside bend) of an elbow of a user who is carrying the infant seat 10 by supporting the first arm 22 of the handle 14 in the crook of the elbow. In this example, the first cushion pad 16 is an inner-elbow pad. In one design, for added user comfort, the first cushion pad 16 extends at least partially around the first arm 22 to cover a portion of the surface of the first arm 22 which is more than just the first inwardly-facing surface 28 of the first arm 22. In one construction, the infant seat 10 also includes a second cushion pad 36 which is attached to the second arm 24 and which defines a portion of the second inwardly-facing surface 30 of the second arm 24.

Typically, but not necessarily, the handle 14 is rotatable to different locked positions with respect to the infant-seat shell 12. Preferably, the first and second arms 22 and 24 are rigid and are comprised of a plastic. Preferably, the first and second cushion pads 16 and 36 comprise an elastomeric material. It is preferred that the first and second cushion pads 16 and 36 are directly or indirectly (through a cushion-pad housing) attached, respectively, to the first and second arms 22 and 24 using an adhesive. Typically, but not necessarily, the outer surface of the first and second cushion pads 16 and 36 each have a convex shape.

In a second expression of the preferred embodiment of the invention shown in FIGS. 1–4, the infant car seat 10 includes an infant-seat shell 12, a handle 14, and a third cushion pad 38. The infant-seat shell 12 includes a first sidewall 18 having a first outwardly-facing surface 40 and includes a second sidewall 20 having a second outwardly-facing surface 42. The handle 14 includes a first arm 22 attached to the first sidewall 18, a second arm 24 attached to the second sidewall 20, and a hand-grip 26 disposed between, and attached to, the first and second arms 22 and 24. The first arm 22 has a first outwardly-facing surface portion 44 which faces away from the second arm 24, and the second arm 24 has a second outwardly-facing surface portion 46 which faces away from the first arm 22. The third cushion pad 38 is attached to one of the first sidewall 18 and the first arm 22 and defines a portion of a corresponding one of the first outwardly-facing surface 40 of the first sidewall 18 and the first outwardly-facing surface portion 44 of the first arm 22. In one construction, shown in FIGS. 1–3, the one of the first sidewall 18 and the first arm 22 is the first arm 22, and the third cushion pad 38 defines a portion of the first outwardly-facing surface portion 44 of the first arm 22. In another construction, not shown in the figures, the one of the first sidewall 18 and the first arm 22 is the first sidewall, and the third cushion pad defines a portion of the first outwardly-facing surface of the first sidewall. In a further construction, not shown in the figures, both the first sidewall and the first arm each have a third cushion pad.

In one example, the third cushion pad 38 defines a minority portion of the corresponding one of the first outwardly-facing surface 40 of the first sidewall 18 and the first outwardly-facing surface portion 44 of the first arm 22. Preferably, the third cushion pad 38 is permanently attached to one of the first sidewall 18 and the first arm 22. In another example, the third cushion pad 38 is disposed to contact a hip of an average-sized adult user who is carrying the infant seat 10 by supporting the first arm 22 of the handle 14 in a crook of an elbow. In this example, the third cushion pad 38 is a hip pad. In one construction, the infant seat 10 also includes a fourth cushion pad 48 which is attached to one of the second sidewall 20 and the second arm 24 and which defines a portion of a corresponding one of the second outwardly-facing surface 42 of the second sidewall 20 and the second outwardly-facing surface portion 46 of the second arm 24. In one design, the first arm 22 includes a first hub 50 attached to the first sidewall 18, and the third cushion pad 38 is attached to the first arm 22 at the first hub 50. It is noted that the third cushion pad 38 is softer and more resilient than, and preferably protrudes above, the adjacent non-cushion-pad portion of the corresponding one of the second outwardly-facing surface 42 of the second sidewall 20 and the second outwardly-facing surface portion 46 of the second arm 24.

Preferably, the third and fourth cushion pads 38 and 48 comprise the same material as the first and second cushion pads 16 and 36. It is preferred that the third and fourth cushion pads 38 and 48 are directly or indirectly (through a cushion-pad housing) attached, respectively, to one of the first sidewall and the first arm and to one of the second sidewall and the second arm using the same technique used to attach the first and second cushion pads 16 and 36. Typically, but not necessarily, the outer surface of the third and fourth cushion pads 38 and 48 each have a convex shape.

In a third expression of the preferred embodiment of the invention shown in FIGS. 1–4, the infant car seat 10 combines the elements of the previously-discussed first and second expressions of the preferred embodiment of the invention. In operation, for shorter-distance carries, the handle-grip carry mode is used wherein the user of the infant seat 10 uses one hand to grasp the handle grip 26 and carry the infant seat 10 (and the infant). In operation, for longer-distance carries, the inside-elbow carry mode is used wherein the user of the infant seat 10 places his or her right forearm around, for example, the first arm 22 of the handle 14 and positions the crook (i.e., the inside bend) of his or her elbow, associated with that forearm, against the first cushion pad 16. As the weight of the infant seat 10 (and the infant) is thus being supported by the right forearm of the user, the third cushion pad 38 will rest against and/or on the right hip of the user. Typically the infant faces the user in this carry mode.

Figure 5:
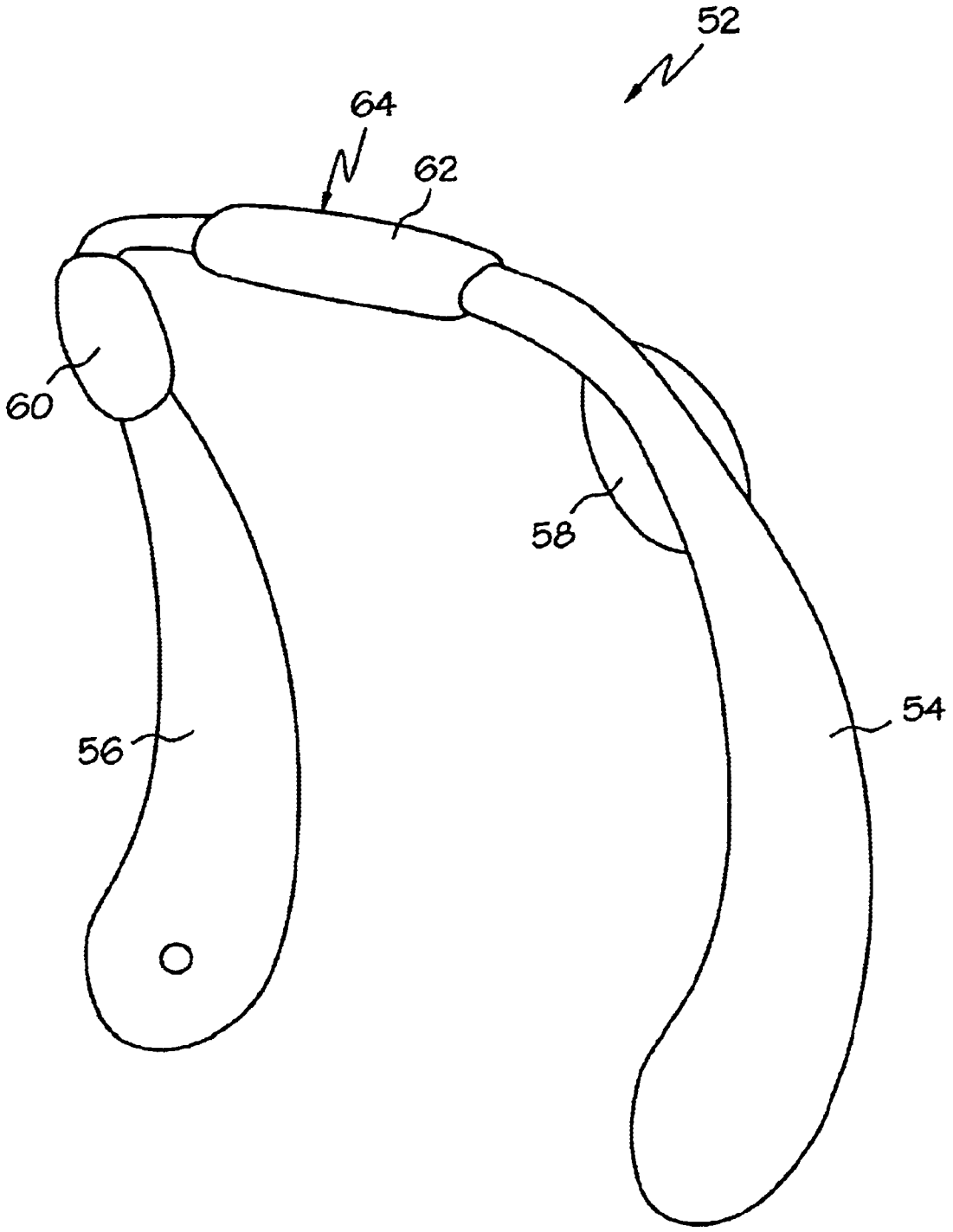
FIG. 5 is a schematic, perspective view of a first alternate embodiment of the handle of FIG. 3.
Figure 6:
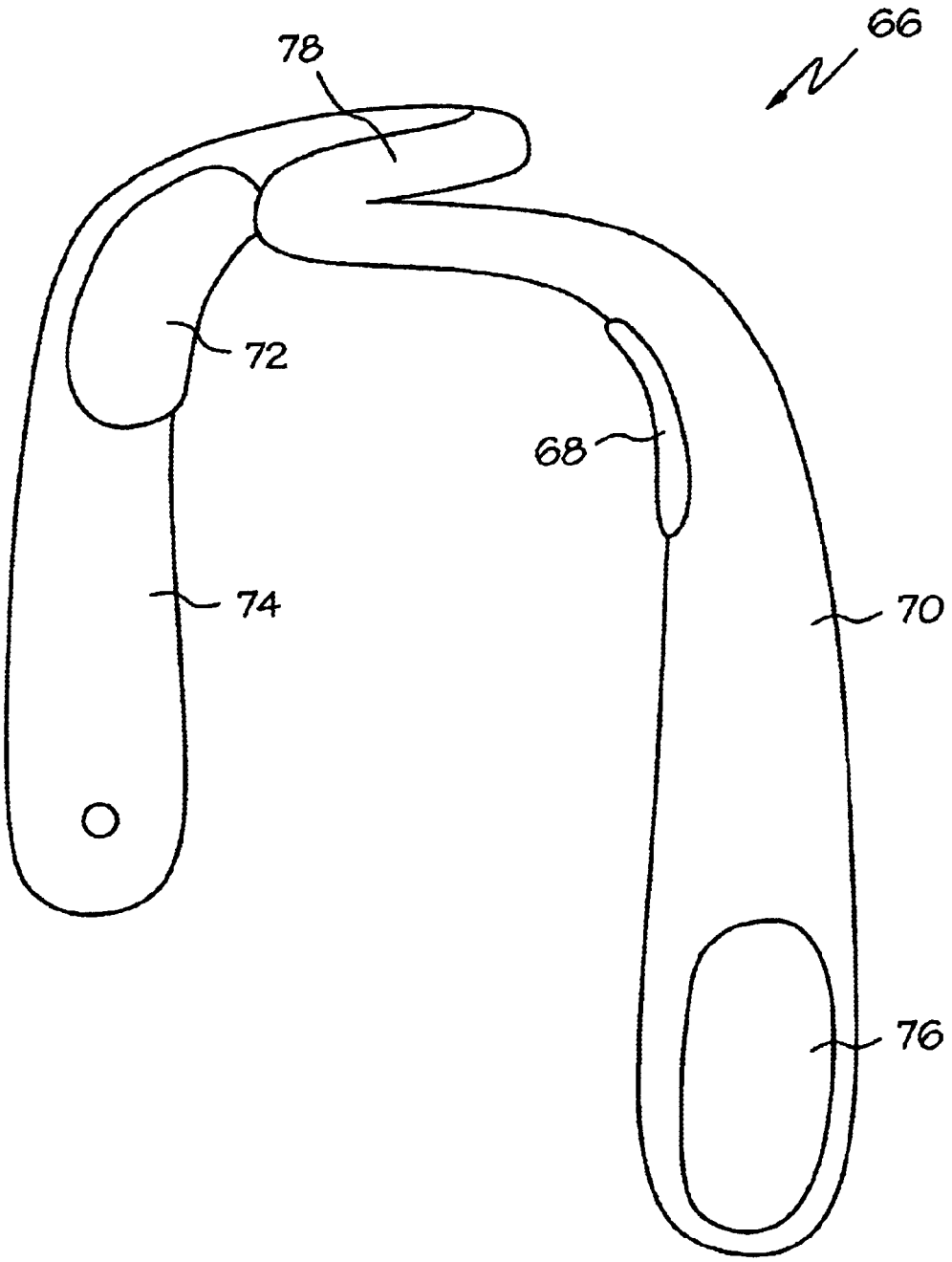
FIG. 6 is a schematic, perspective view of a second alternate embodiment of the handle of FIG. 3.

FIG. 5 shows a first alternate embodiment of the handle 52 including first and second arms 54 and 56 which are curved when seen from the side of the handle. A first cushion pad 58 is attached to the first arm 54, and a second cushion pad 60 is attached to the second arm 56. The handle 52 is shown without the hip pads installed. A fifth cushion pad 62 surrounds, is attached to, and defines the outer surface of, the hand grip 64 of the handle 52. FIG. 6 shows a second alternate embodiment of the handle 66 which is a "Z"-shaped handle (the "Z" shape being best seen from the top of the handle). The handle 66 is shown with a first cushion pad 68 attached to the inwardly-facing surface of the first arm 70, a second cushion pad 72 attached to the inwardly-facing surface of the second arm 74, and a third cushion pad 76 attached to the outwardly facing surface portion, of the first arm 70, which faces away from the second arm 74. The "Z"-shaped handle 66 includes a hand grip 78 which allows the infant seat to be carried for shorter distances by one hand without the user having to rotate his or her wrist.

Several benefits and advantages are derived from the invention. The hand grip of the two-armed handle allows a user to conveniently grasp and carry the infant seat for short distances. For longer distances, the two arms of the handle allow a right or left arm one-hand carry of the cushion seat by having the user place his or her forearm around one of the arms of the handle to primarily support the infant seat from the crook (i.e., the inside bend) of the elbow of the user and to secondarily support the infant seat from and/or against the hip of the user. The first (and second) cushion pad provides comfort for the crook of the elbow of the user, and the third (and fourth) cushion pad provides comfort for the hip of the user.

The foregoing description of several expressions of a preferred embodiment of the invention, and alternate embodiments of the handle thereof, has been presented for purposes of illustration. It is not intended to be exhaustive or to limit the invention to the precise form disclosed, and obviously many modifications and variations are possible in light of the above teaching. It is intended that the scope of the invention be defined by the claims appended hereto.

What is claimed is:

1. An infant seat comprising:

an infant-seat shell including first and second sidewalls;

a handle including a first arm attached to the first sidewall, a second arm attached to the second sidewall, and a hand-grip disposed between and attached to the first and second arms, wherein the handle is attached to the infant-seat shell only at the first and second arms, wherein the first arm has a first inwardly-facing surface, and wherein the second arm has a second inwardly-facing surface; and a first cushion pad permanently attached substantially at the juncture of the underside of the hand-grip and the inside of the first arm and defining a portion of the first inwardly-facing surface, wherein the first cushion pad is disposed to contact a crook of an elbow of a user who is carrying the infant seat by supporting the first arm of the handle in the crook of the elbow with the first sidewall disposed to face a hip of the user.

2. The infant seat of claim 1, also including a second cushion pad attached to the second arm and defining a portion of the second inwardly-facing surface of the second arm.

3. The infant seat of claim 1, wherein the first inwardly-facing surface of the first arm has a first section facing substantially toward the second arm, and wherein the first cushion pad defines a portion of the first section.

4. The infant seat of claim 3, wherein the first inwardly-facing surface of the first arm has a second section facing substantially toward the infant-seat shell, and wherein the first cushion pad defines a portion of the second section.

5. An infant seat comprising:

an infant-seat shell including a first sidewall having a first outwardly-facing surface and including a second sidewall having a second outwardly-facing surface;

a handle including a first arm attached to the first sidewall, a second arm attached to the second sidewall, and a hand-grip disposed between and attached to the first and second arms, wherein the handle is attached to the infant-seat shell only at the first and second arms, wherein the first arm has a first inwardly-facing surface and has a first outwardly-facing surface portion which faces away from the second arm, and wherein the second arm has a second inwardly-facing surface and has a second outwardly-facing surface portion which faces away from the first arm;

a first cushion pad permanently attached substantially at the juncture of the underside of the hand-grip and the inside of the first arm and defining a portion of the first inwardly-facing surface of the first arm, wherein the first cushion pad is disposed to contact a crook of an elbow of a user who is carrying the infant seat by supporting the first arm of the handle in the crook of the elbow with the first sidewall disposed to face a hip of the user;

a second cushion pad permanently attached substantially at the juncture of the underside of the hand-grip and the inside of the second arm and defining a portion of the second inwardly-facing surface of the second arm;

a third cushion pad attached to one of the first sidewall and the first arm and defining a portion of a corresponding one of the first outwardly-facing surface of the first sidewall and the first outwardly-facing surface portion of the first arm, wherein the third cushion pad is disposed to contact a hip of an average-sized adult user who is carrying the infant seat by supporting the first arm of the handle in a crook of an elbow with the first sidewall disposed to face the hip of the average-sized adult user; and a fourth cushion pad attached to one of the second sidewall and the second arm and defining a portion of a corresponding one of the second outwardly-facing surface of the second sidewall and the second outwardly-facing surface portion of the second arm.

* * * * *